United States Patent [19]

Hosooka

[11] 4,012,008

[45] Mar. 15, 1977

[54] WINDOW SASH BALANCER

[75] Inventor: Shuichi Hosooka, Namerikawa, Japan

[73] Assignee: Yoshida Kogyo Kabushiki Kaisha, Tokyo, Japan

[22] Filed: Oct. 29, 1975

[21] Appl. No.: 626,825

[30] Foreign Application Priority Data

Nov. 6, 1974 Japan ..... 49-135028[U]

[52] U.S. Cl. ..... 242/107; 16/198

[51] Int. Cl.[2] ..... B65H 75/48; E05D 13/12

[58] Field of Search ..... 16/198; 49/200; 242/107, 107.5; 254/168

[56] References Cited

UNITED STATES PATENTS

| | | | |
|---|---|---|---|
| 1,599,872 | 9/1926 | Braen | 16/198 |

FOREIGN PATENTS OR APPLICATIONS

| | | | |
|---|---|---|---|
| 109,833 | 2/1940 | Australia | 16/198 |
| 704,761 | 4/1966 | Italy | 49/200 |
| 263,185 | 8/1927 | United Kingdom | 16/198 |

*Primary Examiner*—Werner H. Schroeder
*Assistant Examiner*—Conrad L. Berman
*Attorney, Agent, or Firm*—Hill, Gross, Simpson, Van Santen, Steadman, Chiara & Simpson

[57] ABSTRACT

A window sash balancer is provided for use with slide-out sash windows, double-hung sash windows or the like. The balancer includes a housing, a shaft rotatably supported in the housing and having one end projecting beyond the housing, and a spring disposed within the housing and having one end secured to the housing and the other end to the shaft. The spring normally biases the shaft in one direction of rotation. The shaft has at its projecting end a drum of a frustoconical shape around which there is wound a wire member. A cord is provided in and along a spiral groove defined by adjacent turns of the wound wire member and has one end secured to the drum, the other end being adapted to be connected to a window sash.

4 Claims, 3 Drawing Figures

WINDOW SASH BALANCER

BACKGROUND OF THE INVENTION

1. Field of the Invention

This invention relates generally to window sash balancers for use with slide-out sash windows, double-hung sash windows or the like.

2. Prior Art

Window sash balancers to which the invention relates are of the type including a spirally grooved drum of a frustoconical shape around which there is wound in the spiral groove a cord having one end fixed to the drum and the other end secured to the top end of the window sash, which top end is guided for sliding movement along the vertical guideway of a window outer frame in which the window sash is mounted. The drum is provided with and urged by a spiral coiled spring in a direction to resist the rotation of the drum as the latter is rotated about its own axis by the cord when the latter is pulled downwardly by the window sash, thereby balancing the window sash with respect to the window outer frame under the tension of the cord. Heretofore, the above-mentioned spiral groove of the balancers has been formed circumferentially in the drum body by machining or casting, and therefore adjacent groove threads provide a fixed pitch therebetween which in turn limits the use of each balancer to a window sash of a given weight. This has led to the drawback that when it is necessary to use window sashes having different weights, the balancers must have as many different cast or machined grooves as there are sashes. Furthermore, the prior art balancers of this type are difficult to manufacture with increased rate of production on account of the necessity of machining or casting of the grooved drums and hence very costly.

SUMMARY OF THE INVENTION

The primary object of the present invention is therefore to provide a window sash balancer which is adaptable for use with window sashes of different weights.

Another object of the invention is the provision of a window sash balancer which is less costly to manufacture.

In accordance with this invention, the frustoconical drum has a wire member wound therearound to provide a spiral groove for the cord. By selecting wire members having different diameters, the window sash balancer can be adapted to window sashes having different weights.

These and other objects and advantages of the invention will appear more clearly from the following description taken in conjunction with the accompanying drawing which illustrates preferred embodiments by way of example and in which like reference numerals denote like parts throughout the views.

DESCRIPTION OF THE PREFERRED EMBODIMENTS

Figure 1:
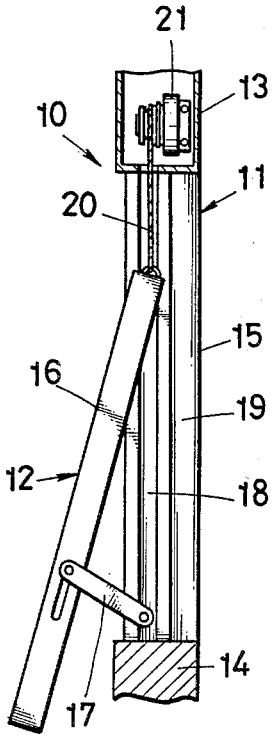
FIG. 1 is a side elevational view of a slide-out sash window, shown in partial cross-section and incorporating a window sash balancer according to the invention.

In FIG. 1, there is shown a window assembly generally indicated by the numeral 10 which is herein shown for illustrative purposes to be a slide-out sash window. The slide-out sash window 10 broadly comprises an outer fixed frame 11 adapted for installation in an opening in a building wall (not shown), and a sash 12 arranged for pivotally sliding in and out between the closed and open positions with respect to the outer fixed frame 11.

As is conventional in the art, the outer fixed frame 11 includes a header 13, a sill 14 spaced vertically from the header 13, and a pair of side jambs 15 extending vertically between the header 13 and the sill 14. The outer fixed frame 11, as shown, has one of the side jambs 15 omitted for clarity of illustration. The sash 12 comprises an inner frame 16 pivotally connected to the side jamb 15 by a stay bar 17. The inner frame 16 includes a top rail (not shown) which has a vertical longitudinal end with a slide or other suitable means (not shown) adapted for up-and-down sliding movement along a guideway 18 formed along an inner surface 19 of the side jamb 15. Secured to the top sash of the sash inner frame 16 is one end of a cord 20 which extends vertically from a window sash balancer 21 disposed within the header 13. The balancer 21 makes it possible to balance the window sash 12 relative to the outer fixed frame 11 under the tension of the cord 20 as hereafter described.

Figure 2:
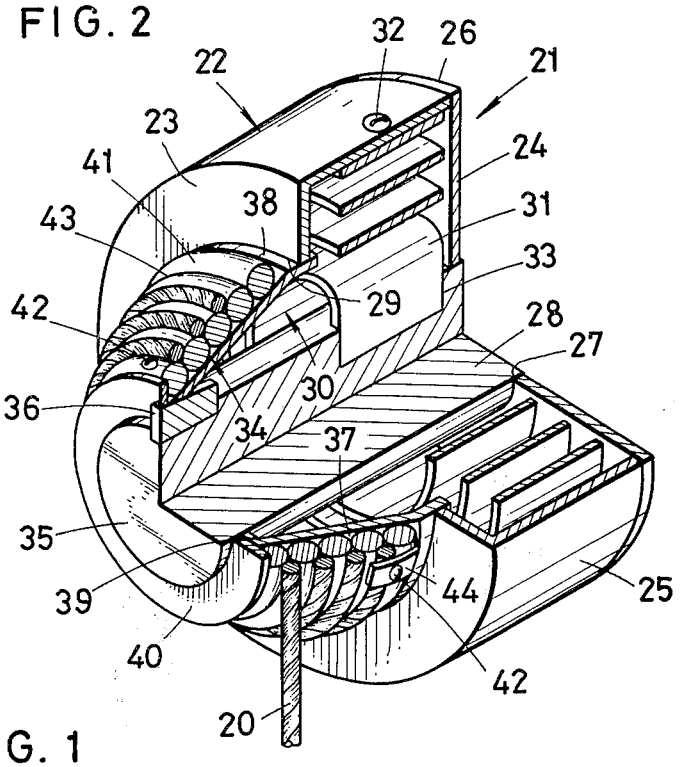
FIG. 2 is an enlarged perspective view, with parts broken away, of the window sash balancer shown in FIG. 1.

As shown in FIG. 2, the window sash balancer 21 constructed according to the invention has a housing 22 of a hollow, annular structure which includes a front wall 23, a rear wall 24 spaced axially from the front wall 23, and a sleeve 25 extending from and at right angles to the front wall 23 and secured to a marginal edge 26 of the rear wall 24. The rear wall 24 has a central hole 27 in which there is rotatably journaled a shaft 28 extending axially beyond the front wall 23 through an opening 29 therein which is coaxial with the hole 27. The opening 29 is so dimensioned as to provide an annular space 30 between the shaft 28 and the front wall 23. A spiral coiled spring 31 is disposed within the hollow housing 22 and has an outermost end secured to the sleeve 25 by a screw 32, an innermost end 33 thereof being embedded in or otherwise fixed to the rotatable shaft 28. The spiral coiled spring 31 serves to normally bias the shaft 28 in a direction to give resistance to the rotation thereof about its own axis as the shaft 28 rotates clockwise as shown in FIG. 2.

A drum 34 of a substantially frustoconical shape is fitted over and secured to a front end portion 35 of the shaft 28 by a key 36 for corotation with the shaft 28. The drum 34 has a peripheral wall 37 flared radially and rearwardly with respect to the axis of the shaft 28 and terminating in a rear marginal edge 38 which extends horizontally and fits slidably in the opening 29 in the front wall 23. An annular flange 40 is attached to the smaller front end 39 of the drum 34 and extends at right angles to the axis of the shaft 28.

A wire member 41 is wound around the peripheral drum wall 37 with its turns spaced closely to each other, both ends of the wire member 41 being secured to the peripheral wall 37 by means of a pair of screws 42, 42. As shown in FIG. 2 the wire member 41 is a round steel wire which, after being coiled around the drum 34, has adjacent turns which define a spiral groove 43 therebetween extending along the wound wire 41. The cord 20 is also coiled around the drum 34 and extends in and along the spiral groove 43 with the other end of the cord 20 being secured to the drum 34 at a position adjacent to the rear marginal edge 38 by securing plate 44.

When the window sash 12 slides pivotally out of the window 10 as it is pulled downwardly toward the open position, the slide attached to the top rail of the sash 12 is moved downwardly along the guideway 18 on the outer fixed frame 11. Simultaneously, the cord 20 is drawn downwardly to cause the drum 34 and the shaft 28 to rotate about their axis against an opposing biasing force of the spiral coiled spring 31. The cord 20 is thus unwound from the drum 34 under constant tension, until the sash 12 is brought downwardly to a desired position at which it is held in place by the tension on the cord 20 which is imparted by the bias of the spiral coiled spring 31. Conversely, when the sash 12 is moved upwardly, such movement is aided by the bias of or force from the spring 31.

Figure 3:
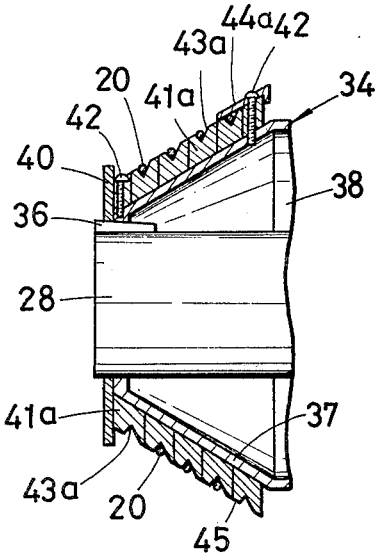
FIG. 3 is a partial, vertical cross-sectional view, on an enlarged scale, of another embodiment of the invention.

FIG. 3 shows another embodiment of the invention in which a wire member 41*a* is a steel wire having a parallelogramatic cross-section, the wire being wound around the drum 34 and having both ends secured to the drum wall 37 by the screws 42. A groove 43*a* of V-shaped cross-section extends along the entire length of an outer peripheral surface 45 of the steel wire 41*a*, and along which groove the cord 20 is disposed, the cord having one end fixed to the steel wire 41*a* adjacent the drum edge 38 by means of a securing plate 44*a*. The groove 43*a* may have other cross-sectional shapes, such as an arcuate cross-section.

Advantageously, the balancer 21 of the invention can be adapted to window sashes having different weights by selecting the proper diameter (width) of the wire members 41 (41*a*). More specifically, where a wire member 41 (41*a*) having a relatively small diameter (width) is used, the pitch or distance between the adjacent groove threads 43 (43*a*) and the diameters of the threads are reduced. When the cord 20 is drawn downwardly as the window 10 is opened, it will be subjected to greater tension than the case where the wire member 41 (41*a*) has a relatively large diameter (width). With smaller wire diameter more turns of the coiled cord 20 are wound on the drum 34, and the radius of such turns constitutes a shortened moment arm acting on the spring. Therefore, a small-diameter wire 41 (41*a*) allows the balancer 21 to be used with a window sash 12 having a relatively large weight. When the balancer 21 is to be applied to window sashes having relatively small weights, then wire members 41 (41*a*) having relatively large diameters (widths) are used.

While specific embodiments of the invention have been described in detail above, it is to be understood that various modifications may be made from the specific details described without departing from the spirit and scope of the invention.

What is claimed is:

1. A balancer for use with window sashes, comprising in combination:

a. a housing;

b. a shaft rotatably supported in said housing and having one end projecting beyond said housing;

c. a spring member disposed within said housing and having one end secured to said housing and the other end to said shaft, said spring member being adapted to normally bias said shaft in a one direction of rotation;

d. a drum of a frustoconical shape secured to said projecting end of said shaft;

e. a wire member wound around and secured to said drum and providing a spiral groove; and f. a cord coiled along said spiral groove and having one end fixed to said drum, the other end being adapted to be secured to the window sash, the unwinding of said cord being in the same direction as the tensioning of said spring member.

2. A balancer according to claim 1, in which said wire member has a round cross-section.

3. A balancer according to claim 1, in which said wire member is a wire of a parallelogramatic cross-section having a groove extending along its entire length.

4. A balancer according to claim 1, including means jointly securing one end of each of said wire member and said cord to said drum.

* * * * *